US008378894B2

(12) United States Patent
Kikuchi et al.

(10) Patent No.: US 8,378,894 B2
(45) Date of Patent: Feb. 19, 2013

(54) ANTENNA DEVICE

(75) Inventors: Masato Kikuchi, Tokyo (JP); Shunsuke Mochizuki, Tokyo (JP); Masahiro Yoshioka, Tokyo (JP); Ryosuke Araki, Tokyo (JP); Masaki Handa, Tokyo (JP); Takashi Nakanishi, Tokyo (JP); Hiroto Kimura, Tokyo (JP); Seiji Wada, Kanagawa (JP); Hiroshi Ichiki, Kanagawa (JP); Tetsujiro Kondo, Tokyo (JP)

(73) Assignee: Sony Corporation, Tokyo (JP)

( * ) Notice: Subject to any disclaimer, the term of this patent is extended or adjusted under 35 U.S.C. 154(b) by 363 days.

(21) Appl. No.: 12/273,038

(22) Filed: Nov. 18, 2008

(65) Prior Publication Data

US 2009/0153405 A1 Jun. 18, 2009

(30) Foreign Application Priority Data

Dec. 18, 2007 (JP) ..... 2007-326392

(51) Int. Cl.

| | |
|---|---|
| ***H01Q 1/38*** | (2006.01) |
| ***H01Q 5/00*** | (2006.01) |
| ***H01Q 9/04*** | (2006.01) |
| ***H01Q 1/48*** | (2006.01) |

(52) U.S. Cl. ..... 343/700 MS; 343/846

(58) Field of Classification Search ..... 343/700 MS, 343/846

See application file for complete search history.

(56) References Cited

U.S. PATENT DOCUMENTS 4,170,013 A * 10/1979 Black ..... 343/700 MS
6,211,825 B1 4/2001 Deng
6,778,141 B1 * 8/2004 Yeh ..... 343/700 MS
2004/0001021 A1 1/2004 Choo et al.
2005/0253756 A1 11/2005 Kuroda et al.
2007/0200767 A1 8/2007 Yoshioka et al.

FOREIGN PATENT DOCUMENTS

JP 2005-278067 10/2005
WO WO 2005/038984 A1 4/2005

OTHER PUBLICATIONS

"Antenna Theory: A Review," Balanis, Proc. IEEE, vol. 80, No. 1, Jan. 1992.*

"Antenna Frequency Scaling," The ARRL Antenna Book, published by The American Radio Relay League, Copyright 1988, pp. 2-24 to 2-25.*

"Theory of Models of Electromagnetic Systems," George Sinclair, Proceedings of The IRE, vol. 36, issue 11, Nov. 1948, pp. 1364 to 1370.*

U.S. Appl. No. 12/324,980, filed Nov. 28, 2008, Yoshioka, et al.

Ban-Leong Ooi, "A Double II Stub Proximity Feed U-Slot Patch Antenna," IEEE Transactions on Antennas and Propagation, IEEE Service Center, Piscataway, NJ, USA, vol. 52, No. 9, Sep. 1, 2004, pp. 2491-2496.

European Search Report mail dated Apr. 6, 2011. Supplementary European Search Report in European application EP 08 17 2149.

U.S. Appl. No. 13/217,539, filed Aug. 25, 2011, Ichiki.

* cited by examiner

*Primary Examiner* — Jacob Y Choi
*Assistant Examiner* — Graham Smith
(74) *Attorney, Agent, or Firm* — Oblon, Spivak, McClelland, Maier & Neustadt, L.L.P.

(57) ABSTRACT

A planar antenna device includes a dielectric layer and two conductor layers vertically sandwiching the dielectric layer. The lower conductor layer is used as a ground, and the upper conductor layer forms a radiating element having a structure in which four or more radiating element pieces of different sizes are connected to a feeder line.

6 Claims, 14 Drawing Sheets

Type E-Field (peak)
Monitor e-field (f=4.5) [1]
Component Abs
Maximum-3d 18732.9 V/m at 1.44/7.2/1.5
Frequency 4.5
Phase 0 degrees Type H-Field (peak)
Monitor h-field (f=4.5) [1]
Component Abs
Maximum-3d 67.7467 A/m at -7.2011/-2.61387/0.725
Frequency 4.5
Phase 90 degrees Type H-Field (peak)
Monitor h-field (f=5.0) [1]
Component Abs
Maximum-3d 47.41 A/m at -14.1409/-0.474/0.725
Frequency 5
Phase 90 degrees Type E-Field (peak)
Monitor e-field (f=5.5) [1]
Component Abs
Maximum-3d 20731.9 V/m at -14.1409/7.2/1.5
Frequency 5.5
Phase 112.5 degrees Type H-Field (peak)
Monitor h-field (f=5.5) [1]
Component Abs
Maximum-3d 75.0429 A/m at -2.18658/-7.25/0.725
Frequency 5.5
Phase 22.5 degrees

ANTENNA DEVICE

CROSS REFERENCES TO RELATED APPLICATIONS

The present invention contains subject matter related to Japanese Patent Application JP 2007-326392 filed in the Japanese Patent Office on Dec. 18, 2007, the entire contents of which are incorporated herein by reference.

BACKGROUND OF THE INVENTION

1. Field of the Invention

The present invention relates to an antenna device used to transmit and receive a radio signal, and particularly to an antenna device formed by simple combination of planar conductors including a radiating conductor and a ground conductor plate disposed to face each other with an insulating material interposed therebetween.

2. Description of the Related Art

In wireless communication using a radio wave communication method, a signal is transmitted with the use of a radiation field generated upon passage of current through an aerial (an antenna). The antenna has a variety of types. An antenna having a wide band characteristic can be used in communication which transmits and receives signals by diffusing the signals over an ultra wide frequency band such as a UWB (Ultra Wide Band). Further, a small-size antenna contributes to a reduction in size and weight of a wireless device.

In particular, an antenna configuration satisfying a request for a thinner antenna includes an antenna device configured such that a radiating conductor and a ground conductor plate are disposed to face each other with an insulating material interposed therebetween, i.e., a microstrip patch antenna (hereinafter abbreviated simply as the patch antenna). The shape of the radiating conductor is not particularly determined, but is rectangular or circular in most cases. The thickness of the insulating material interposed between the radiating conductor and the ground conductor plate is generally set to be equal to or less than one tenth of the wavelength of a radio frequency. Thus, the patch antenna can be formed into a substantially thin shape. Further, the patch antenna can be manufactured by an etching process performed on an insulating material substrate copper-clad on both sides thereof, and thus can be manufactured with relative ease. That is, it is relatively easy to manufacture the patch antenna.

For example, a magnetic microstrip patch antenna has been proposed in which short-circuiting conductor plates for making a radiating conductor and a ground conductor conductive are appropriately disposed at respective positions for suppressing excitation in an undesired mode, to thereby suppress disturbance in a radiation pattern at an end of a band, and in which a magnetic material having a relative permittivity of one or higher and having a multilayer structure including alternate lamination of a magnetic layer and an air layer is used to fill the gap between the radiating conductor plate and the ground conductor plate, to thereby realize unidirectivity in a wide bandwidth (see US Patent Application No. 2005/253756, for example).

A normal printed board has a structure in which a thin dielectric plate is vertically sandwiched by two conductor plates. If the printed board is structured such that the lower conductor plate is used as a ground (GND), and that the upper conductor plate is formed into a rectangular or circular shape and fed with electric power, a patch antenna can be formed and easily integrated with the circuit board.

FIGS. 15 and 16 illustrate an exemplary configuration of a patch antenna formed on the printed board (FIG. 15 is a top view of the printed board and FIG. 16 is an oblique view of the printed board). The patch antenna illustrated in FIGS. 15 and 16 is designed with an antenna formed by an upper conductor plate (101, 201) (a radiating element) that is regarded as a resonator. Further, current flowing along an end edge of the conductor plate is considered to be equal to current flowing through a parallel transmission line 104 extending across the dielectric material (102, 202). Therefore, the patch antenna has a wavelength reduction effect according to the relative permittivity of the dielectric material (202). If it is assumed that a length L of the radiating element is equal to a width W of the radiating element, the patch antenna is represented by the following equation. FIG. 16 also shows a lower conductor layer 203 that is used as a ground (GND). FIG. 15 shows a connection point 103 between parallel transmission line 104 and the upper conductor plate 101.

Formula 1

$$L = W = \frac{\lambda}{2\sqrt{\varepsilon_{eff}}} = \frac{\lambda}{2} \tag{1}$$

Herein, $\in_{eff}$ represents the effective permittivity of the dielectric substrate, and $\lambda_g$ represents the effective wavelength. The effective permittivity $\in_{eff}$ can be determined on the basis of the permittivity and the thickness of the dielectric substrate and the value of the width W of the antenna (=the length L of the antenna). The above Equation (1) shows that, if the length or width of the antenna (the radiating element) is reduced to half the effective wavelength, resonance occurs to radiate radio waves of a resonance frequency.

Communication systems of recent years can be divided into narrow band communication and wide band communication. Frequency components which can be radiated by the patch antenna include a frequency f determined by the following Equation (2) on the basis of the effective wavelength $\lambda_g$ and a higher harmonic component thereof.

Formula 2

$$f = \frac{c}{\lambda_g} \tag{2}$$

That is, the patch antenna generally tends to operate in a narrow band, and thus is considered to be unsuitable for, for example, a PAN (Personal Area Network) system, the operable band of which is necessary to be wide. Bandwidths having a VSWR (Voltage Standing Wave Ratio) of two or less are generally on the order of a few percent, depending on a design parameter. Due to this disadvantage, there is an issue that it is difficult to use the patch antenna in the wide band communication.

A planar patch antenna including a ground on the back surface thereof on a dielectric multilayer board has a narrow band. To ensure the wide band characteristic in the patch antenna of the related art, therefore, a structure not including the ground on the back surface of the antenna is generally employed. In such a case, however, the structure of a housing of an electronic device is complicated in design.

Further, in many of wireless communication techniques in the past, which assume long-distance communication, it suffices if only the behavior of the antenna in a far field is taken into account. In recent years, however, there have been increasing cases assuming close-range communication. Thus, it has been becoming necessary to understand phenomena occurring in a near field of the antenna, in which the communication distance is equal to or shorter than the wavelength.

SUMMARY OF THE INVENTION

It is desirable to provide an antenna device of a superior patch antenna configuration formed by simple combination of planar conductors including a radiating conductor and a ground conductor plate disposed to face each other with an insulating material interposed therebetween.

It is further desirable to provide an antenna device of a superior planar shape formed by simple combination of planar conductors and having an operable bandwidth of 1.5 GHz or greater.

It is further desirable to provide an antenna device of a superior planar shape formed by simple combination of planar conductors and operable even in a near field in which the communication distance is equal to or shorter than the wavelength.

The present invention has been made with the above issues taken into account. A planar antenna device according to an embodiment of the present invention includes a dielectric layer and two conductor layers vertically sandwiching the dielectric layer. The lower conductor layer is used as a ground, and the upper conductor layer forms a radiating element having a structure in which four or more radiating element pieces of different sizes, i.e., different widths and lengths are connected to a feeder line in the width direction of the radiating element.

As an antenna device satisfying a request for a thinner antenna, a patch antenna has been known. In a normal printed board having a structure in which a thin dielectric plate is vertically sandwiched by two conductor plates, if the lower conductor plate is used as a ground, and if the upper conductor plate is subjected to processing such as etching to form a radiating element, a patch antenna can be manufactured.

However, an effective wavelength $\lambda_g$ of the patch antenna is determined by a conductor size, i.e., a width W and a length L of the radiating element. Therefore, the patch antenna generally tends to operate in a narrow band, and thus is considered to be unsuitable for wide band communication. Further, in recent years, opportunities for close-range communication have been increasing. Therefore, it is necessary to understand phenomena occurring in a near field of the antenna, in which the communication distance is equal to or shorter than the wavelength.

Meanwhile, the antenna device according to the embodiment of the present invention, which is configured to include a dielectric layer and two conductor layers vertically sandwiching the dielectric layer similarly as in the patch antenna, the lower conductor layer is used as a ground, and a radiating element formed by the upper conductor layer is configured such that four or more radiating element pieces of different sizes, i.e., different widths and lengths are connected to a feeder line in the width direction of the radiating element.

The antenna device according to the embodiment of the present invention includes the plurality of radiating element pieces of different widths and lengths. Thus, when the respective radiating element pieces operate as a resonator and radiate radio waves, the effective wavelength of the radio waves is different among the radiating element pieces. Therefore, the antenna device operates in the respective effective wavelengths, and thus can have a wide band characteristic.

Further, in ideal point charge, the electric field attenuates in inverse proportion to the square of the distance, and thus communication in a far field is assumed. Meanwhile, the antenna device according to the embodiment of the present invention includes the plurality of radiating element pieces of different widths and lengths. Therefore, the shape of the charge is complicated. Accordingly, components of the electric field attenuating in inverse proportion to the third or fourth power of the distance emerge. That is, the attenuation of the components due to the distance is rapid. Accordingly, communication in a near field is realized.

Herein, when the radiating element includes an N number of the radiating element pieces having widths $W_0$, $W_1$, . . . , and $W_{N-1}$ and lengths $L_0$, $L_1$, . . . , and $L_{N-1}$, respectively, and connected in the width direction to the feeder line having a width $W_N$, the widths and the lengths of the respective radiating element pieces can be selected for an effective wavelength $\lambda_g$ determined by a frequency desired to be transmitted, as shown in the following Equations (3) to (8) (wherein N represents an integer equal to or greater than five, and a subscript of $W_i$ represents an integer ranging from zero to N-1 assigned to each of the radiating element pieces as a serial number in order of decreasing distance from the feeder line). Further, an appropriate value can be selected as the width $W_N$ of the feeder line in consideration of the impedance of a transmission line.

Formula 3

$$L_0 \approx \lambda_g/2 \tag{3}$$

$$\sum_{i=0}^{N-1} W_i + W_N/2 \approx \lambda_g/2 \tag{4}$$

$$W_0 > W_1 > \ldots > W_{N-2} \tag{5}$$

$$L_0 > L_1 > \ldots > L_{N-2} \tag{6}$$

$$W_0 \approx W_{N-1} \tag{7}$$

$$L_0 \approx L_{N-1} \tag{8}$$

That is, the width and length of the radiating element piece most distant from the feeder line and the width and length of the radiating element piece adjacent to the feeder line are set to a substantially equal and maximum value, and the lengths $L_0$ and $L_{N-1}$ of the radiating element pieces are set to be substantially equal to $\lambda_g/2$. Further, the sum of the widths of all of the radiating element pieces added with half the width of the feeder line is set to be substantially equal to $\lambda_g/2$.

It can be understood from the above Equations (3) to (8) that the planar antenna applied with the embodiment of the present invention can be provided with an area smaller than the area W×L of the square patch antenna of the related art (see FIGS. 15 and 16).

The planar antenna device according to the embodiment of the present invention does not cause strong resonance, as observed in a reflection characteristic S11 (see FIG. 7). Therefore, it can be said that the antenna device acts not as a resonant antenna in which standing waves are confined only to a particular portion on a radiating element, but as a traveling-wave antenna in which a magnetic field (current) travels in conductor portions of different lengths. The present inventors consider that this characteristic is a factor for widening the band of the antenna device.

Further, in the planar antenna device according to the embodiment of the present invention, the transmittable frequency band is wide in a near field, and the fractional bandwidth is wide, as observed in a transmission characteristic S21 (see FIG. 7). Therefore, even if the antenna device is configured to include the ground on the back surface of the antenna, the wide band characteristic can be ensured. Accordingly, the antenna device can contribute to simplification of the design of a housing structure of an electronic device.

The present invention can provide an antenna device of a superior patch antenna configuration formed by simple combination of planar conductors including a radiating conductor and a ground conductor plate disposed to face each other with an insulating material interposed therebetween.

The present invention can further provide an antenna device of a superior planar shape formed by simple combination of planar conductors and operable in a bandwidth of 1.5 GHz or greater even in a near field in which the communication distance is equal to or less than the wavelength.

The planar antenna device according to the embodiment of the present invention exhibits a wide band characteristic absent in the antenna devices of the related art, and is operable also in a proximate environment. Further, the planar antenna device can maintain such characteristics as the original directivity of the planar antenna and the stabilization of electrical components by the ground surface.

The antenna device according to the embodiment of the present invention can operate also in a near field in which the communication distance is approximately equal to or less than the wavelength.

In the antenna device according to the embodiment of the present invention, the shape of the radiating element formed by the plurality of radiating element pieces is substantially determined by the resonance frequency. Further, the antenna device is formed by the simple combination of the planar conductors. Therefore, the antenna device is easily designed. Further, the layer structure of the antenna is realized by the combination of the conductors and the dielectric layer sandwiched therebetween. Therefore, the antenna device can be mounted on a common printed board material.

That is, if the antenna device according to the embodiment of the present invention is used to form a wireless communication device, the wireless communication device can contribute to the enhancement and improvement of the signal quality in communication systems of recent years requested to perform wide band communication at a short distance.

Further purposes, features, and advantages of the present invention will become apparent by reference to further detailed description based on an embodiment of the present invention and the accompanying drawings described later.

DESCRIPTION OF THE PREFERRED EMBODIMENTS

An embodiment of the present invention will be described in detail below with reference to the drawings.

Figure 1:
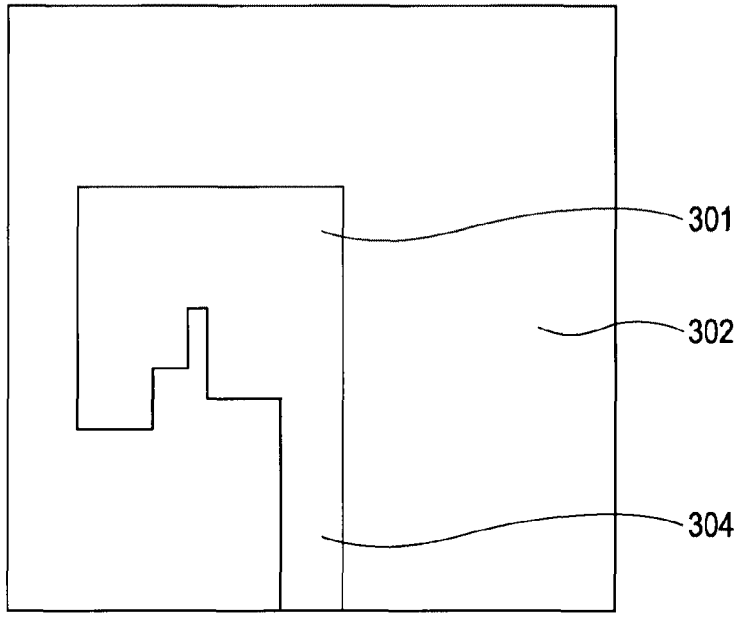
FIG. 1 is a diagram illustrating a configuration of an antenna device according to an embodiment of the present invention.
Figure 2:
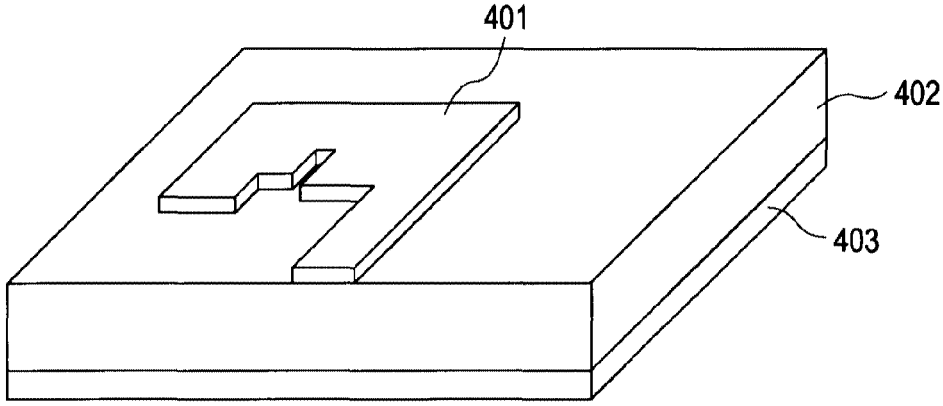
FIG. 2 is a diagram illustrating the configuration of the antenna device according to the embodiment of the present invention.

FIGS. 1 and 2 illustrate a configuration of an antenna device according to an embodiment of the present invention. The antenna device illustrated in FIGS. 1 and 2 is a planar antenna having a structure in which a thin dielectric layer (302, 402) is vertically sandwiched by two conductor layers in a printed board similarly as in a patch antenna, and in which the lower conductor layer (403) is used as a ground (GND) and the upper conductor layer (301, 401) is used as a radiating element and fed with electric power (FIG. 1 is a top view of the printed board and FIG. 2 is an oblique view of the printed board). The conductor layers 301, 401, and 403 include copper or silver, for example, and the dielectric layer (302, 402) includes a glass epoxy resin or Teflon (a registered trademark), for example. The patch antenna shown in FIG. 1 also includes a parallel transmission line 304.

Figure 3:
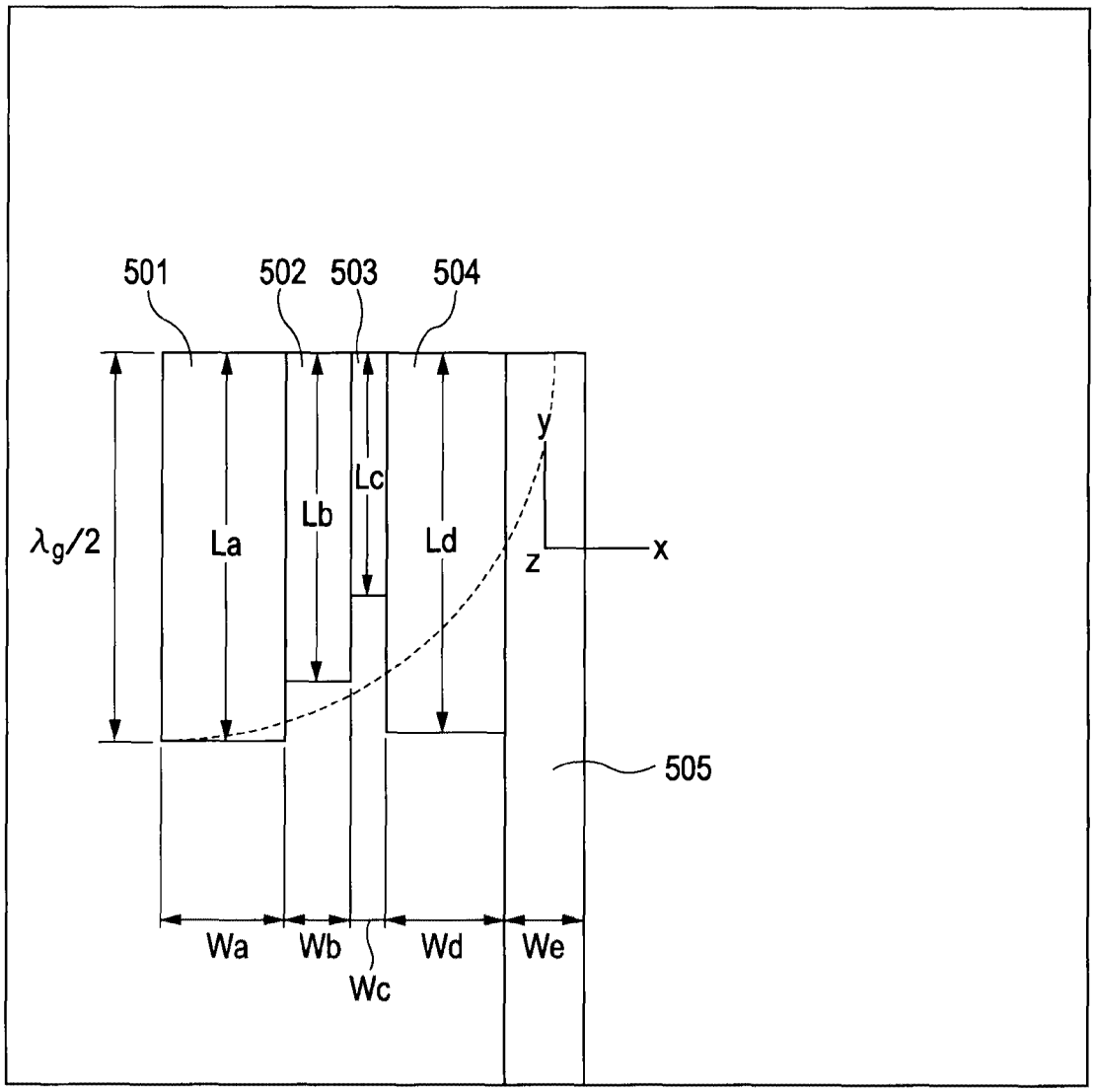
FIG. 3 is a diagram for explaining a specific shape of a radiating element formed by a plurality of radiating element pieces.

The radiating element formed by the upper conductor layer has a structure in which a plurality (four or more) of radiating element pieces 501 to 504 of different sizes, i.e., different widths and lengths are connected to a feeder line 505 in the width direction of the radiating element (see FIG. 3).

Thus configured planar antenna includes the plurality of radiating element pieces of different widths and lengths. Thus, when the respective radiating element pieces operate as a resonator and radiate radio waves, the effective wavelength of the radio waves is different among the radiating element pieces. Therefore, the planar antenna operates in the respective effective wavelengths, and thus can have a wide band characteristic.

Further, in ideal point charge, the electric field attenuates in inverse proportion to the square of the distance, and thus communication in a far field is assumed. Meanwhile, in the planar antenna including the plurality of radiating element pieces of different sizes, the shape of the charge is complicated. Therefore, components of the electric field attenuating in inverse proportion to the third or fourth power of the distance emerge. That is, the attenuation of the components due to the distance is rapid. Accordingly, communication in a near field is realized.

FIGS. 1 and 2 illustrate the planar antenna in which the rectangular radiating element pieces are connected in the width direction of the radiating element to form the single radiating element. The gist of the present invention, however, is not limited to any particular number or shape of the radiating element pieces. For example, it is desired to be well understood that the shape of the conductors may be curved.

With reference to FIG. 3, description will be made of a specific shape of the radiating element formed by the plurality of radiating element pieces 501 to 504.

When the radiating element pieces 501 to 504 have widths Wa, Wb, Wc, and Wd, and lengths La, Lb, Lc, and Ld, respectively, in order of decreasing distance from the feeder line 505, the widths and lengths of the radiating element pieces 501 to 504 are selected for an effective wavelength $\lambda_g$ determined by a frequency desired to be transmitted, as shown in the following Equations (9) to (14), wherein We represents the width of the feeder line 505.

Formula 4

$$L_a \approx \lambda_g/2 \tag{9}$$

$$W_a+W_b+W_c+W_d+W_e/2 \approx \lambda_g/2 \tag{10}$$

$$W_a > W_b > W_c \tag{11}$$

$$L_a > L_b > L_c \tag{12}$$

$$W_a \approx W_d \tag{13}$$

$$L_a \approx L_d \tag{14}$$

Herein, an appropriate value can be selected as the width We of the feeder line 505 in consideration of the impedance of a transmission line.

Figure 15:
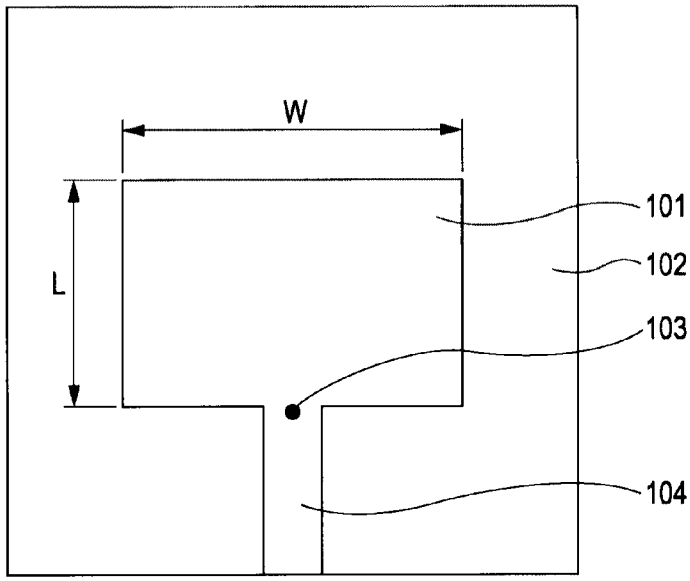
FIG. 15 is a diagram illustrating a typical configuration example of a patch antenna formed on a printed board (a view of the printed board as viewed from above)
Figure 16:
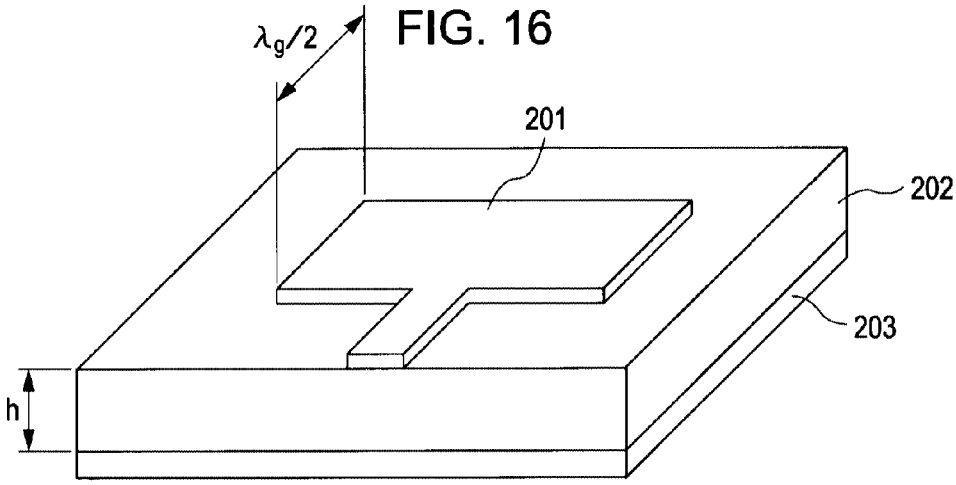
FIG. 16 is a diagram illustrating the typical configuration example of the patch antenna formed on the printed board (a view of the printed board as viewed obliquely).

It can be understood from the above Equations (9) to (14) that the planar antenna illustrated in FIGS. 1 and 2 can be provided with an area smaller than the area W×L of the square patch antenna of the related art (see FIGS. 15 and 16).

As described above, the planar antenna device according to the embodiment of the present invention exhibits the wide band characteristic absent in the antenna devices of the related art, and is operable also in a proximate environment. Further, the planar antenna device can maintain such characteristics as the original directivity of the planar antenna and the stabilization of electrical components by the ground surface.

Subsequently, to describe characteristics in a near field of the planar antenna illustrated in FIGS. 1 and 2, simulation results of the planar antenna compared with simulation results of the patch antenna of the related art will be described below.

Figure 4:
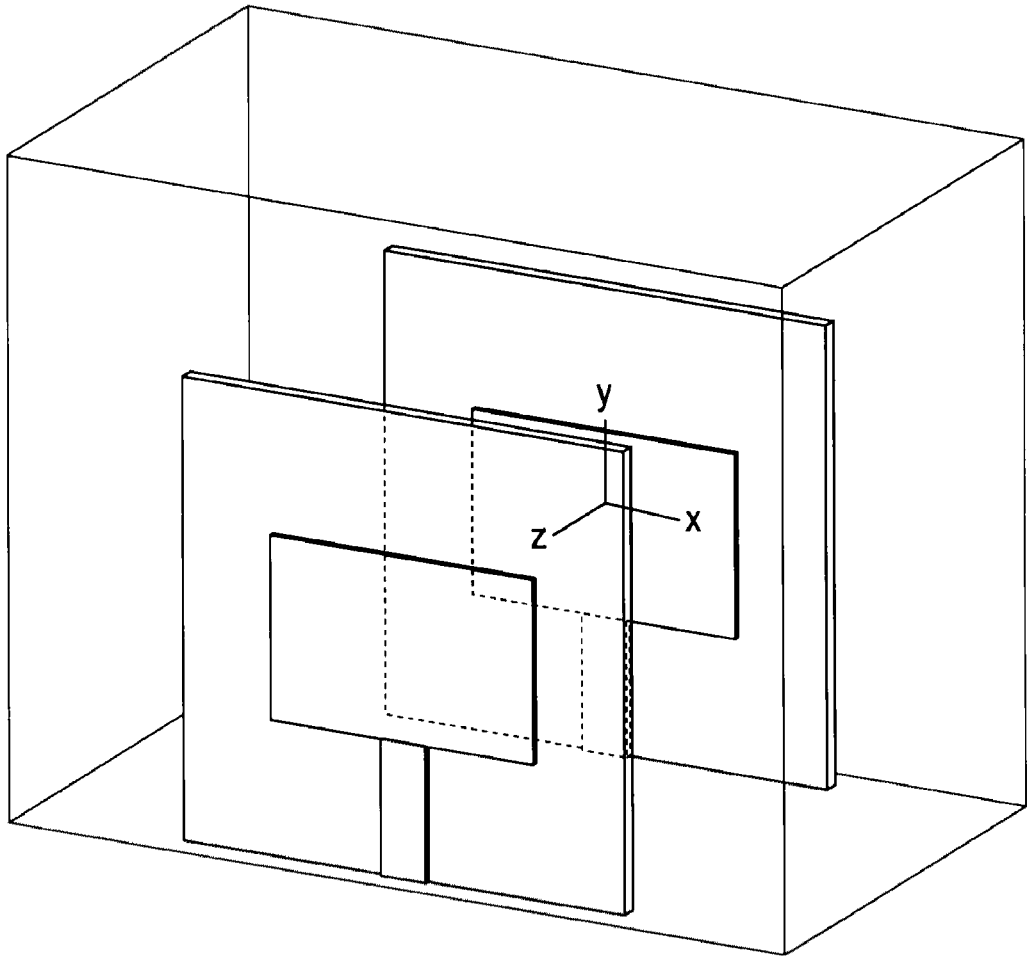
FIG. 4 is a diagram illustrating a state in which two patch antennas are disposed with an inter-antenna distance of 30 mm therebetween such that respective radiating elements of the antennas face each other.
Figure 5:
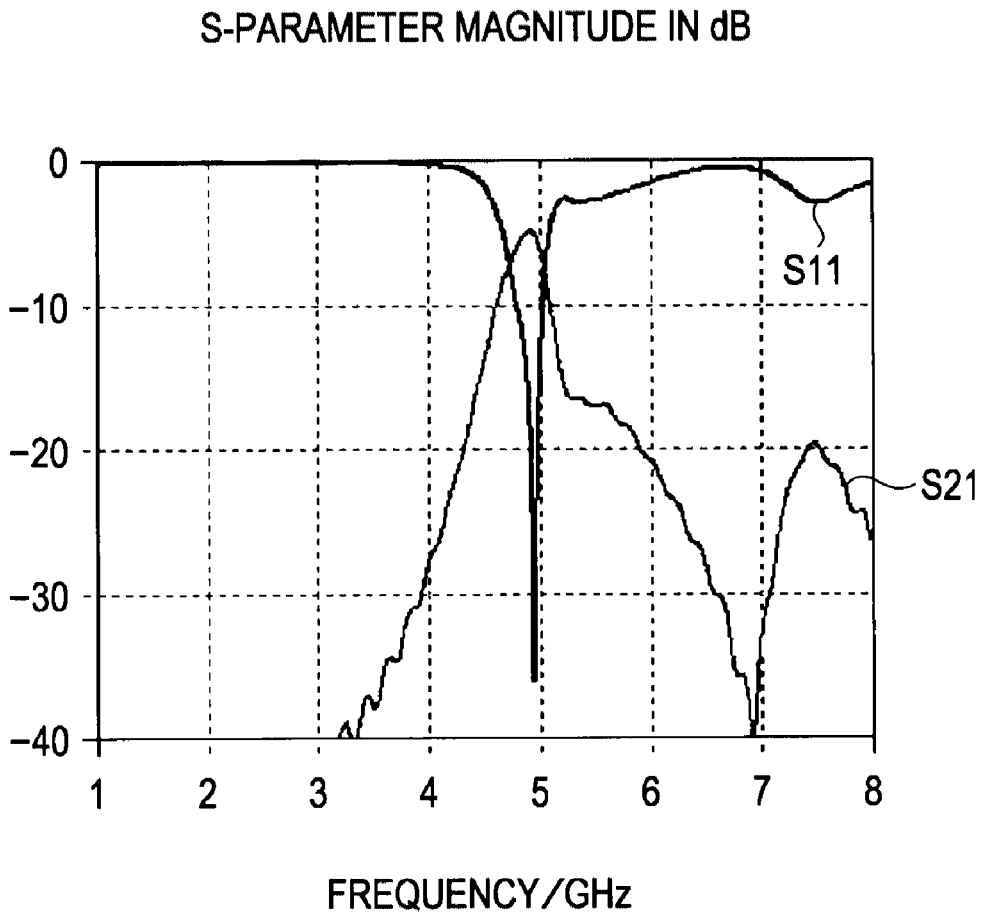
FIG. 5 is a graph showing respective simulation results of a reflection characteristic and a transmission characteristic of the antenna pair illustrated in FIG. 4.
Figure 6:
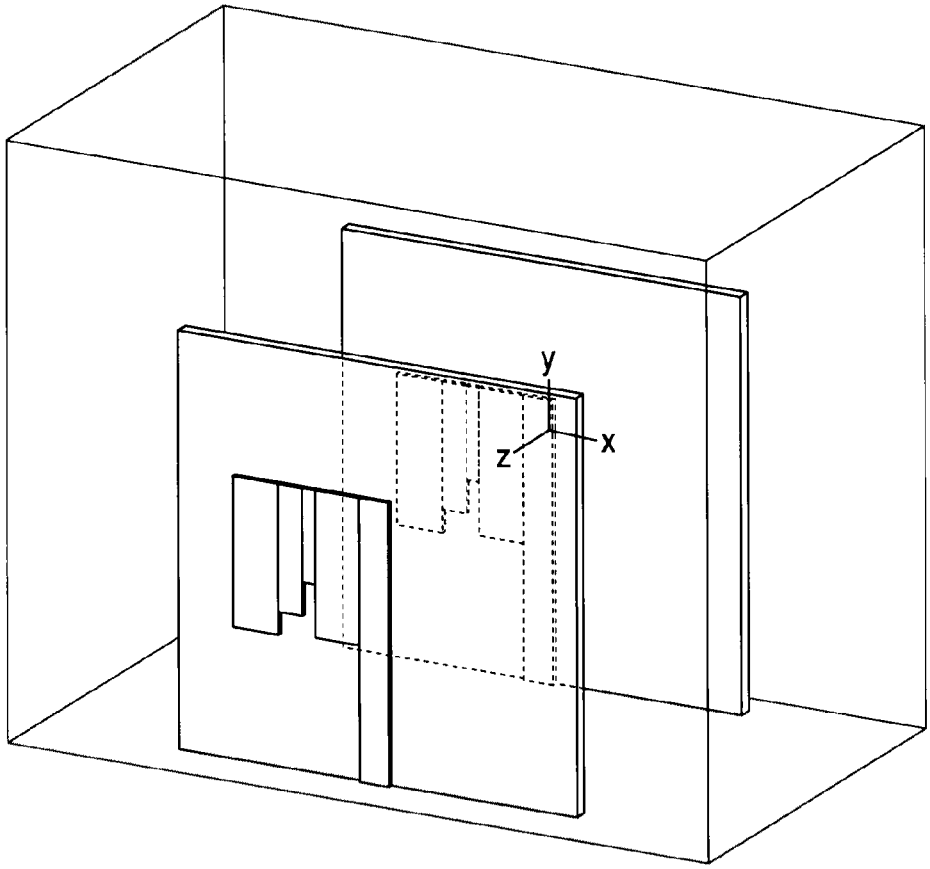
FIG. 6 is a diagram illustrating a state in which two planar antennas illustrated in FIGS. 1 and 2 are disposed with an inter-antenna distance of 30 mm therebetween such that respective radiating elements of the antennas face each other.

FIG. 4 illustrates a state in which two patch antennas are disposed with an inter-antenna distance of 30 mm therebetween such that respective radiating elements of the antennas face each other. The patch antennas illustrated in the drawing are assumed to have the design of the related art illustrated in FIGS. 15 and 16. Meanwhile, FIG. 6 illustrates a state in which two planar antennas illustrated in FIGS. 1 and 2 are similarly disposed with an inter-antenna distance of 30 mm therebetween such that respective radiating elements of the antennas face each other. It is assumed in each of the antennas that the center frequency is set to be around 5 GHz. Further, FIG. 5 shows respective simulation results of a reflection characteristic S11 and a transmission characteristic S21 of the antenna pair illustrated in FIG. 4. Further, FIG. 7 shows respective simulation results of the reflection characteristic S11 and the transmission characteristic S21 of the antenna pair illustrated in FIG. 6.

The reflection characteristic S11 is an amount representing the resonance of an antenna. It is generally considered that the smaller the value of the amount is, the stronger the resonance is. Meanwhile, the transmission characteristic S21 is an amount representing how much electric power is transmitted between two antennas. It is generally considered that the greater the value of the amount is, the more effectively an input signal is transmitted to the output side.

Figure 7:
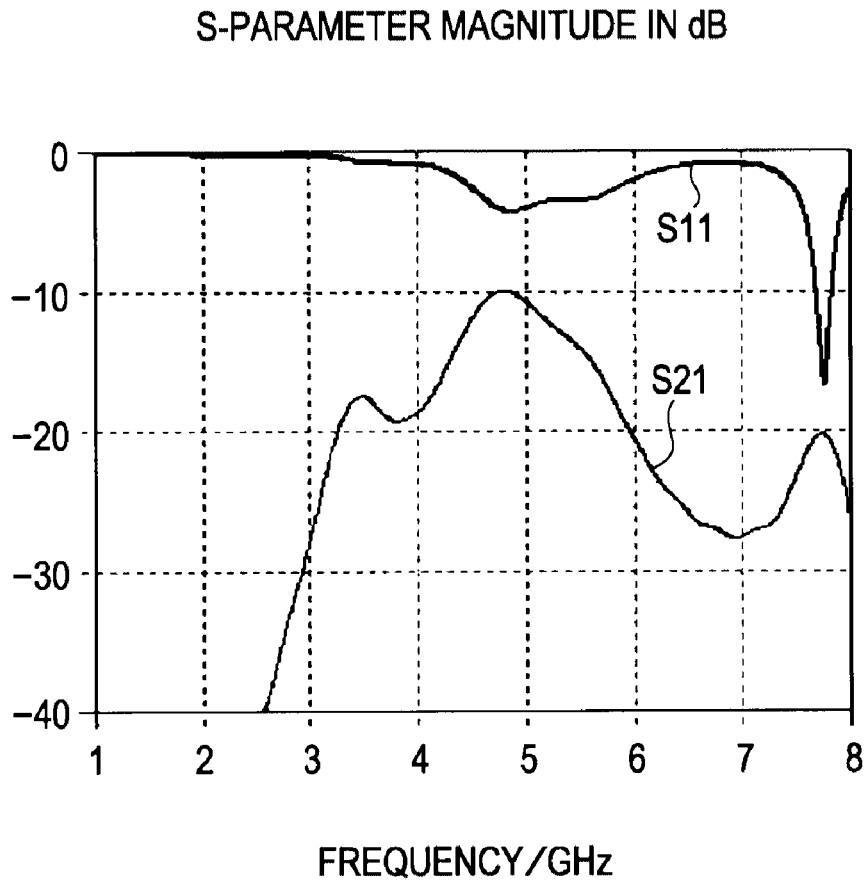
FIG. 7 is a graph showing respective simulation results of a reflection characteristic and a transmission characteristic of the antenna pair illustrated in FIG. 6.

It is observed in the reflection characteristic S11 in FIG. 7 that strong resonance is not generated. That is, it can be said that the planar antenna illustrated in FIGS. 1 and 2 acts not as a resonant antenna in which standing waves are confined only to a particular portion on a radiating element, but as a traveling-wave antenna in which a magnetic field (current) travels in conductor portions of different lengths. The present inventors consider that this characteristic is a factor for widening the band of the planar antenna.

Further, it can be confirmed from the comparison of the transmission characteristic S21 between FIGS. 5 and 7 that the transmittable frequency band of the planar antenna illustrated in FIGS. 1 and 2 is wide in a near field. Further, at a frequency around 5 GHz, the fractional bandwidth (=the band divided by the center frequency) is only approximately 10% in the patch antenna illustrated in FIGS. 15 and 16, while the planar antenna illustrated in FIGS. 1 and 2 can have a fractional bandwidth of approximately 30%.

Generally, a planar patch antenna including a ground on the back surface thereof on a dielectric multilayer board has a narrow band (Current flowing along an end edge of a conductor plate forming a radiating element is considered to be equal to current flowing through a parallel transmission line extending across a dielectric layer, and the wavelength of the current is dominated by the relative permittivity of the dielectric material. That is, the frequency band of transmittable and receivable radio waves is limited to a narrow range dominated by a predetermined permittivity of the dielectric material). To ensure the wide band characteristic in the patch antenna of the related art as illustrated in FIGS. 15 and 16, therefore, a structure not including the ground on the back surface of the antenna is generally employed. Meanwhile, the planar antenna illustrated in FIGS. 1 and 2 includes the ground on the back surface of the antenna, and at the same time has the wide band characteristic, as described above. Accordingly, the planar antenna can contribute to simplification of the design of a housing structure of an electronic device.

Figure 8:
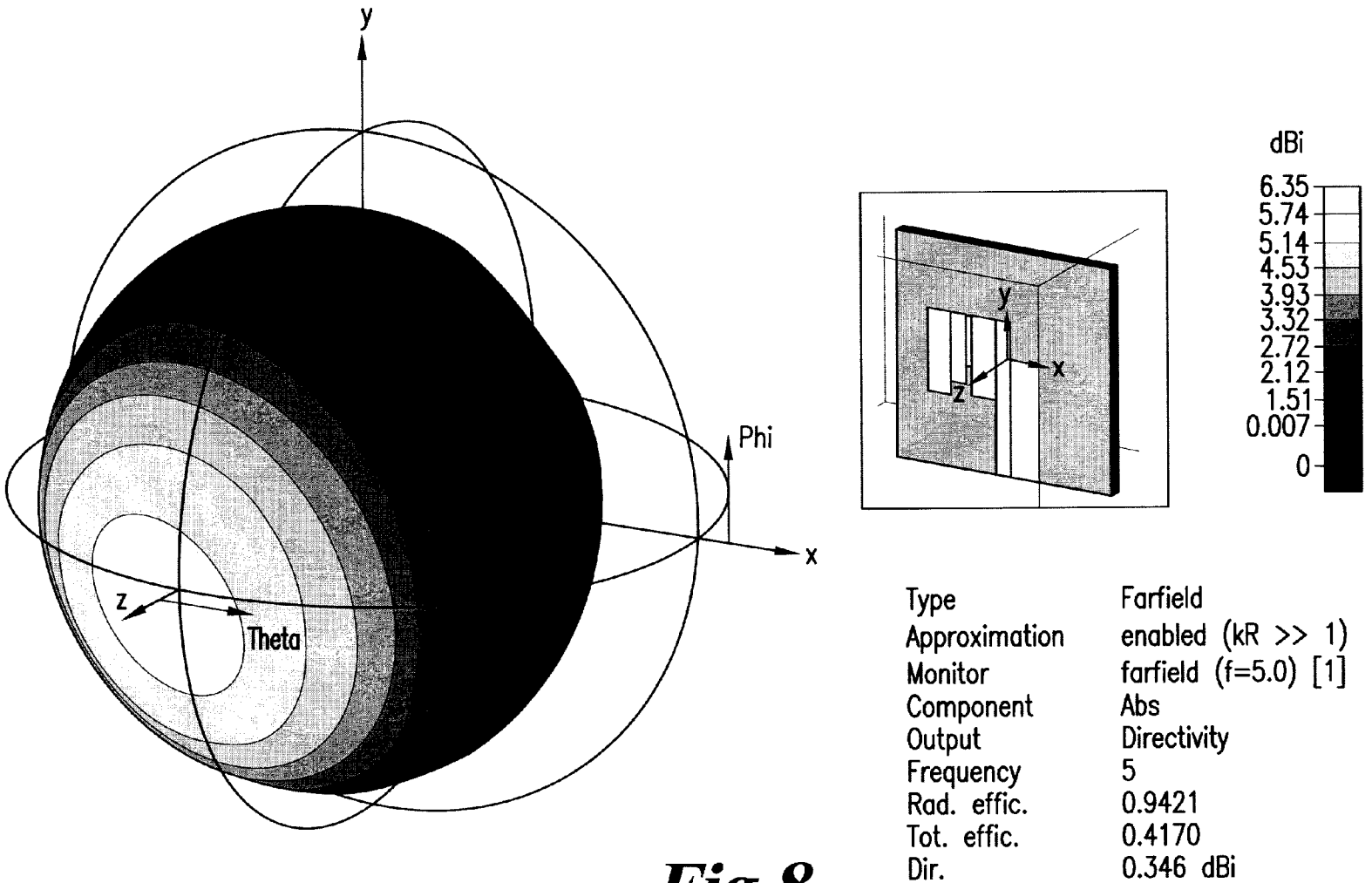
FIG. 8 is a diagram illustrating the radiation of radio waves from the planar antenna illustrated in FIGS. 1 and 2.

FIG. 8 illustrates the radiation of radio waves from the planar antenna illustrated in FIGS. 1 and 2. In the drawing, the intensity of an electromagnetic field radiated from the antenna is shown in gray scale. The drawing shows the most intense radiation of radio waves from a white region, and also shows a decrease in the intensity with a color closer to black. It is understood from the drawing that the direction of the radiation is perpendicular to the antenna surface. Further, radio waves are less likely to be generated on the ground surface of the dielectric substrate. Accordingly, the directivity of the planar antenna can be set in the forward direction.

FIGS. 9 to 14 illustrate, in contours, respective intensity distributions of an electric field and a magnetic field of the planar antenna illustrated in FIGS. 1 and 2 at respective frequencies 4.5 GHz, 5.0 GHz, and 5.5 GHz. In each of the drawings, the intensity of the electric field or the magnetic field is shown in gray scale. The white color represents the highest intensity, while the black color represents the lowest intensity.

Figure 9:
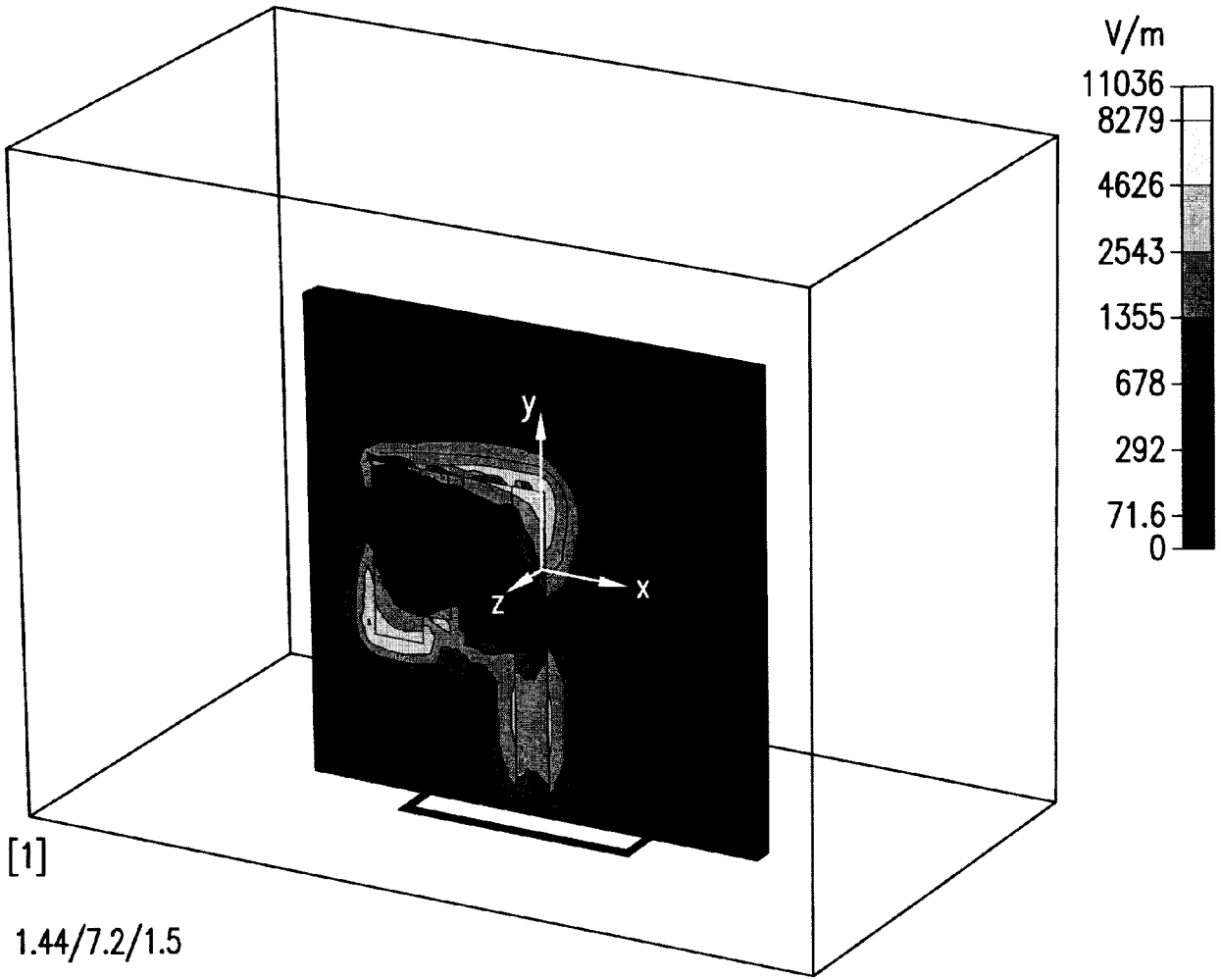
FIG. 9 is a diagram illustrating an intensity distribution of an electric field of the planar antenna illustrated in FIGS. 1 and 2 at a frequency of 4.5 GHz.
Figure 11:
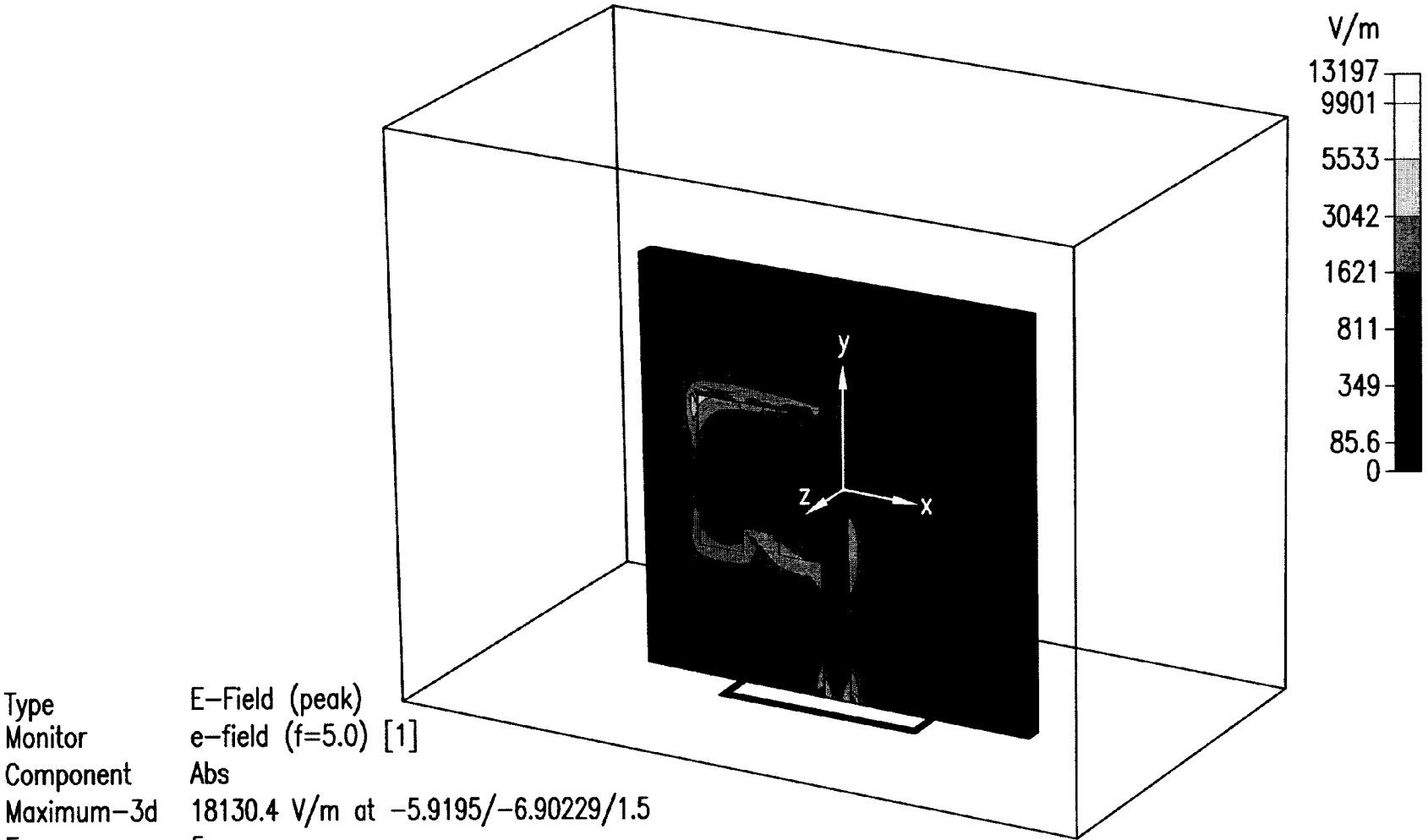
FIG. 11 is a diagram illustrating an intensity distribution of an electric field of the planar antenna illustrated in FIGS. 1 and 2 at a frequency of 5.0 GHz.
Figure 13:
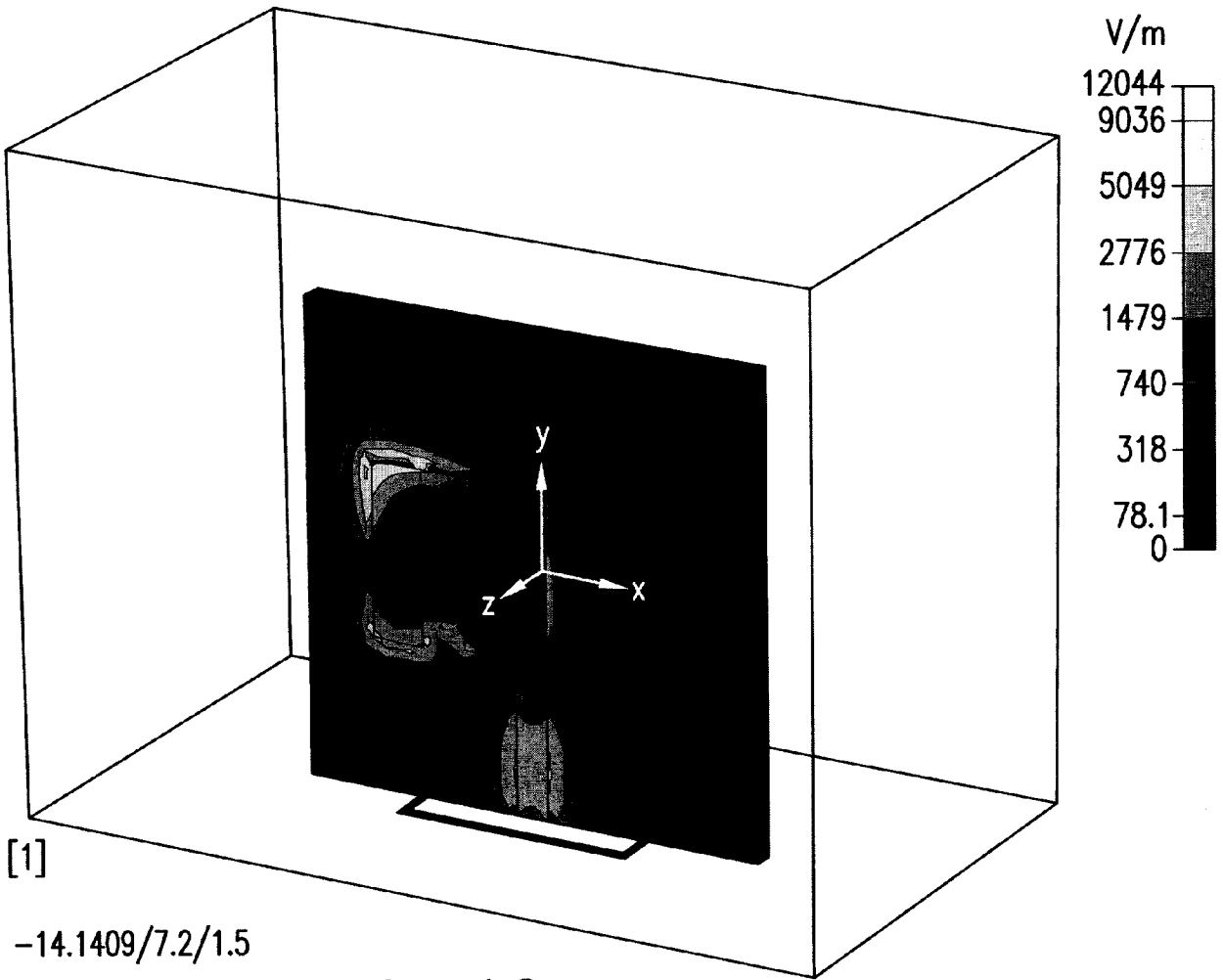
FIG. 13 is a diagram illustrating an intensity distribution of an electric field of the planar antenna illustrated in FIGS. 1 and 2 at a frequency of 5.5 GHz.

Firstly, with reference to FIGS. 9, 11, and 13, the intensity of the electric field of the planar antenna illustrated in FIGS. 1 and 2 is compared among the respective frequencies. It is understood from the comparison that the most intense region of the electric field changes depending on the frequency. This result indicates that electric fields of different frequencies are radiated from a variety of locations on the radiating element, and this characteristic is a factor for widening the band of the planar antenna.

Figure 10:
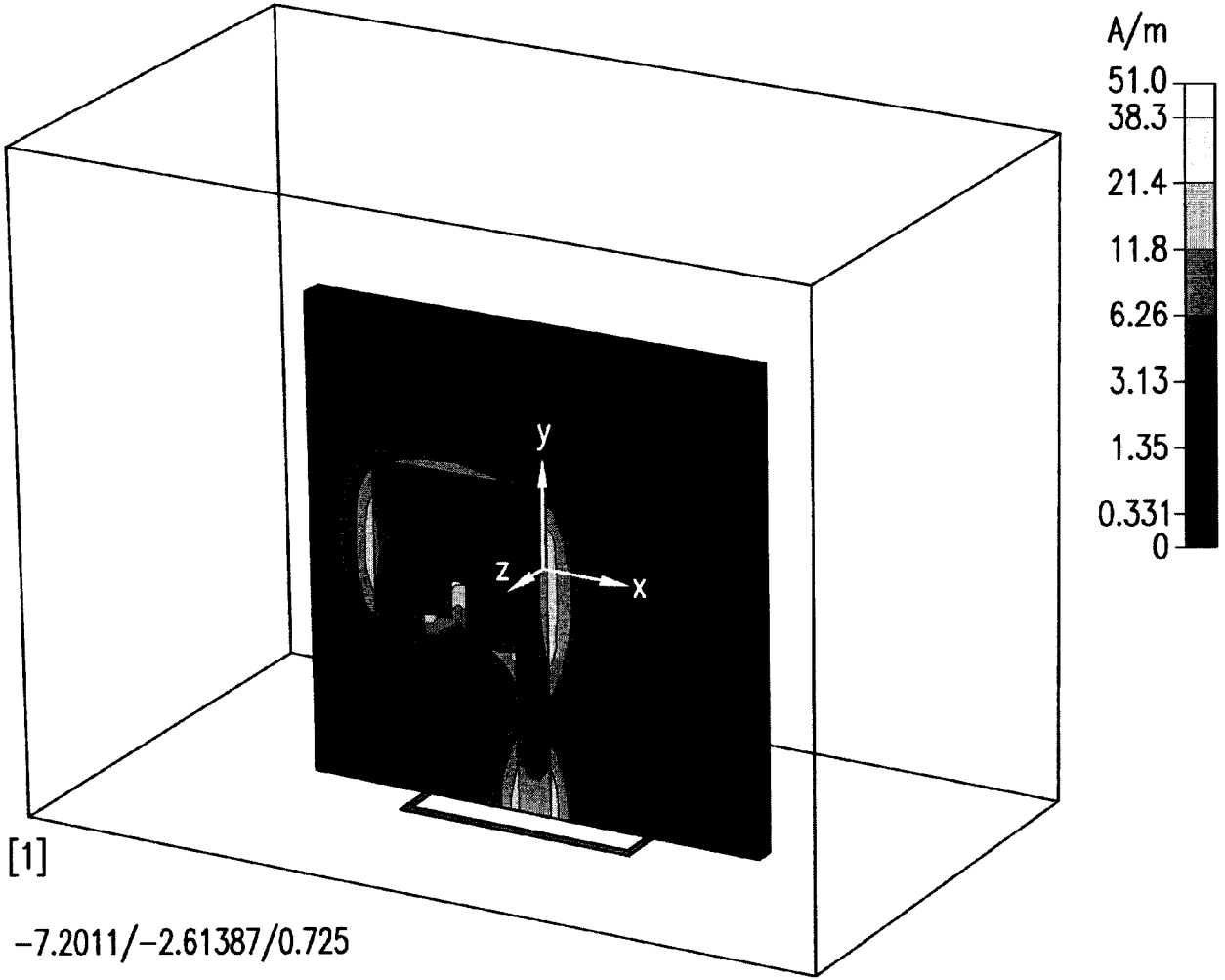
FIG. 10 is a diagram illustrating an intensity distribution of a magnetic field of the planar antenna illustrated in FIGS. 1 and 2 at a frequency of 4.5 GHz.
Figure 12:
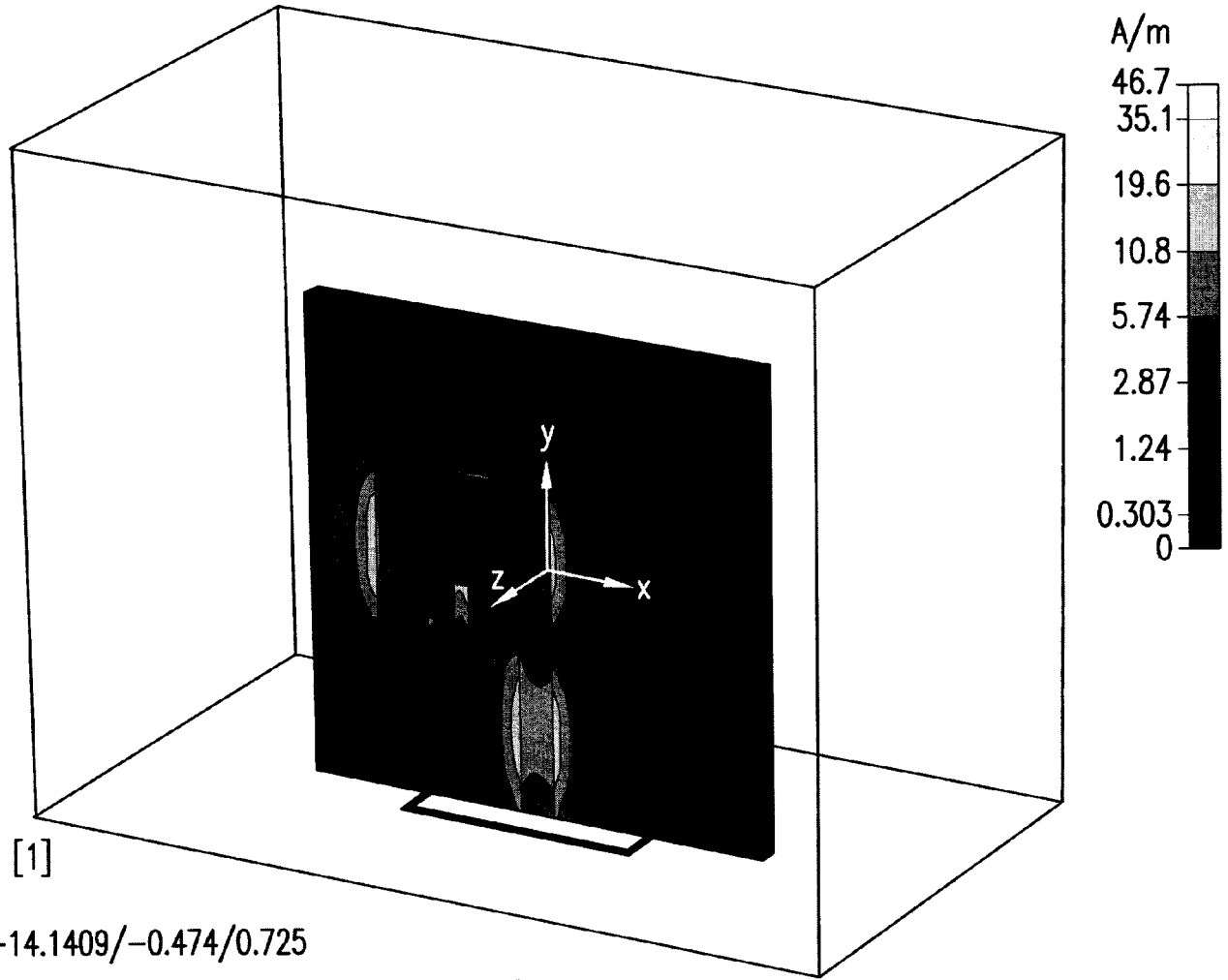
FIG. 12 is a diagram illustrating an intensity distribution of a magnetic field of the planar antenna illustrated in FIGS. 1 and 2 at a frequency of 5.0 GHz.
Figure 14:
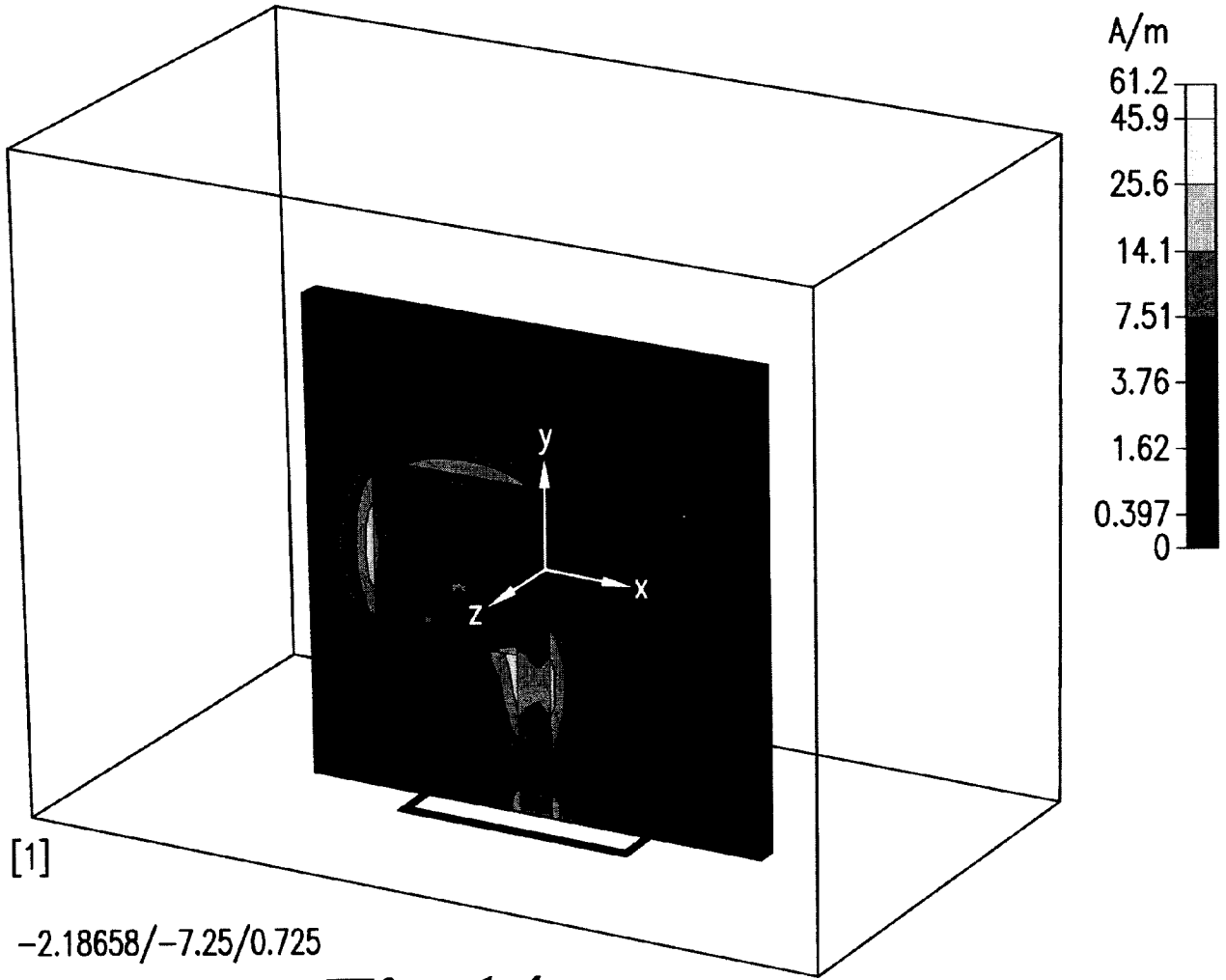
FIG. 14 is a diagram illustrating an intensity distribution of a magnetic field of the planar antenna illustrated in FIGS. 1 and 2 at a frequency of 5.5 GHz.

Subsequently, with reference to FIGS. 10, 12, and 14, the magnetic field distribution of the planar antenna illustrated in FIGS. 1 and 2 is compared among the respective frequencies. It is understood from the comparison that regions each having an intense magnetic field are distributed around edges of the antenna conductor. As shown in FIG. 7, strong resonance is absent in the target frequency band in the reflection characteristic S11. Therefore, the present planar antenna is considered to act not as a resonant antenna in which standing waves are confined only to a particular portion on a radiating element, but as a traveling-wave antenna in which a magnetic field (current) travels in conductor portions of different lengths. Further, the present inventors consider that this characteristic is a factor for widening the band of the present planar antenna.

It should be understood by those skilled in the art that various modifications, combinations, sub-combinations and alterations may occur depending on design requirements and other factors insofar as they are within the scope of the appended claims or the equivalents thereof.

What is claimed is:

1. A planar antenna device, comprising:

a dielectric layer; and an upper and a lower conductor layer that vertically sandwich the dielectric layer, wherein the lower conductor layer is used as a ground, wherein the upper conductor layer forms a single radiating element having a structure in which five or more radiating element pieces are connected to a feeder line, a beginning portion of each of the radiating element pieces being aligned, and the lengths of each of the radiating element pieces defining a terminating portion for the upper conductor and exposing the dielectric layer beyond the terminating portion, and wherein the lengths and widths of the five or more radiating element pieces are selected such that the planar antenna device transmits electric power in at least a 1.5 GHz band in a range of operating frequencies between 4 GHz and 6 GHz for near field communication in which a communication distance is less than or equal to a wavelength corresponding to an operating frequency in the range, wherein the five or more radiating element pieces are each formed into rectangular strips on one side of the feeder line, and are connected in a width direction of the single radiating element to form the single radiating element, wherein, when the single radiating element includes N number of the radiating element pieces having the widths represented as $W_0$, $W_1$, . . . , and $W_{N-1}$ and the lengths represented as $L_0$, $L_1$, . . . , and $L_{N-1}$, respectively, and connected in the width direction to the feeder line, the feeder line having a width $W_N$, the widths and the lengths of the radiating element pieces are selected, for an effective wavelength $\lambda_g$ determined by the operating frequency, in order to satisfy each of formula (1) through formula (6):

$$L_0[[\approx]]=\lambda_g/2 \tag{1}$$

$$\sum_{i=0}^{N-1} W_i + W_N/2 \approx \lambda_g/2 \tag{2}$$

$$W_0>W_1>\ldots W_{N-2} \tag{3}$$

$$L_0>L_1>\ldots>L_{N-2} \tag{4}$$

$$W_0[[\approx]]=W_{N-1} \tag{5}$$

$$L_0[[\approx]]=L_{N-1} \tag{6}$$

wherein N represents an integer equal to or greater than five, and a subscript of $W_i$ and a subscript of $L_i$ represents an integer ranging from zero to N−1 assigned to each of the radiating element pieces as a serial number in order of decreasing distance from the feeder line, and wherein the width $W_N$ of the feeder line is selected based on an impedance of a transmission line.

2. The planar antenna device according to claim 1, wherein the planar antenna device is mounted on a printed board material or a dielectric multilayer board that includes an alternate lamination of a conductor layer and a dielectric layer.

3. The planar antenna device according to claim 1, wherein an effective wavelength of radiated radio waves differs among the radiating element pieces.

4. The planar antenna device according to claim 1, wherein the five or more radiating element pieces are selected such that, for all operating frequencies between 4 GHz and 6 GHz, the planar antenna device has the same predetermined antenna direction for transmitting the electric power.

5. The planar antenna device according to claim 1, wherein the five or more radiating element pieces are selected such that traveling waves are created in which a magnetic field travels in the five or more radiating element pieces.

6. The planar antenna device according to claim 5, wherein the magnetic field does not include standing waves that are confined to only a specified portion of at least one of the five or more radiating element pieces.

* * * * *